US011166529B2

(12) United States Patent
Cuenat et al.

(10) Patent No.: US 11,166,529 B2
(45) Date of Patent: Nov. 9, 2021

(54) WATCH CASE COMPRISING REMOVABLE HORNS

(71) Applicant: LVMH Swiss Manufactures SA, La Chaux-de-Fonds (CH)

(72) Inventors: Laurent Cuenat, La Chaux-de-Fonds (CH); Laurent Raille, Maiche (FR)

(73) Assignee: LVMH SWISS MANUFACTURES SA, La Chaux-de-Fonds (CH)

( * ) Notice: Subject to any disclaimer, the term of this patent is extended or adjusted under 35 U.S.C. 154(b) by 437 days.

(21) Appl. No.: 16/099,778

(22) PCT Filed: Apr. 19, 2017

(86) PCT No.: PCT/IB2017/052224
§ 371 (c)(1),
(2) Date: Nov. 8, 2018

(87) PCT Pub. No.: WO2017/195054
PCT Pub. Date: Nov. 16, 2017

(65) Prior Publication Data

US 2019/0174882 A1 Jun. 13, 2019

(30) Foreign Application Priority Data

May 10, 2016 (CH) ..... 00610/16

(51) Int. Cl.
*G04B 37/14* (2006.01)
*A44C 5/14* (2006.01)
(Continued)

(52) U.S. Cl.
CPC ..... *A44C 5/147* (2013.01); *A44C 5/2028* (2013.01); *G04B 37/1486* (2013.01); *G04B 37/0008* (2013.01)

(58) Field of Classification Search
CPC .. A44C 5/147; A44C 5/2028; G04B 37/1486; G04B 37/0008
(Continued)

(56) References Cited

U.S. PATENT DOCUMENTS 2,765,108 A * 10/1956 Doerwald ..... G04B 37/12 224/174
4,234,115 A * 11/1980 Williams ..... A44C 5/145 224/168
(Continued)

FOREIGN PATENT DOCUMENTS

CH 321188 A 4/1957
CH 355094 A 6/1961
(Continued)

OTHER PUBLICATIONS

Translation of Office Action for corresponding Japanese application No. 2018-559260 dated Nov. 21, 2019.
(Continued)

*Primary Examiner* — Sean Kayes
(74) *Attorney, Agent, or Firm* — Pearne & Gordon LLP

(57) ABSTRACT

Watch case including: a middle; at least one pair of horns intended to retain a wristwatch strap portion; the middle including a first lock member; and a second lock member mounted on the pair of horns and complementary to the first member to lock the pair of horns to the middle. The case also includes a manipulation member that can be manipulated by a user in order to move the second member between a locking position in which the members co-operate to maintain the pair of horns on the middle and a release position in which the pair of horns can be detached from the middle.

18 Claims, 23 Drawing Sheets

(51) Int. Cl.
*A44C 5/20* (2006.01)
*G04B 37/00* (2006.01)

(58) Field of Classification Search
USPC ..... 224/171, 177, 168
See application file for complete search history.

(56) References Cited

U.S. PATENT DOCUMENTS 5,732,048 A * 3/1998 Klingenberg ..... G04B 37/1486 224/167
5,838,642 A * 11/1998 Tully ..... A44C 5/14 368/282
8,256,952 B2 * 9/2012 Loiseau ..... G04B 37/0427 368/281
8,613,127 B2 * 12/2013 Kaltenrieder ..... G04B 37/1493 24/265 WS
10,506,853 B2 * 12/2019 Bazin ..... G04B 37/1486
2007/0028428 A1 2/2007 Cretin
2007/0253290 A1 * 11/2007 Aire ..... G04B 39/00 368/294
2010/0302913 A1 * 12/2010 Loiseau ..... G04B 37/0427 368/281
2016/0040698 A1 2/2016 Perkins et al.

FOREIGN PATENT DOCUMENTS

CH 701221 A1 12/2010
CH 705240 A2 1/2013
CH 706260 A2 9/2013
EP 0400206 A1 12/1990
EP 0471834 A1 2/1992
EP 1902641 A1 3/2008
EP 2188676 A1 5/2010
EP 2431825 A1 3/2012
EP 2487548 A1 8/2012
EP 2636328 A1 9/2013
FR 3021128 A1 11/2015
JP S5698013 U 8/1981
JP S6235511 U 3/1987

OTHER PUBLICATIONS

International Search Report for PCT/IB2017052224 dated Sep. 20, 2017.

* cited by examiner

WATCH CASE COMPRISING REMOVABLE HORNS

The present application claims the priority of the Swiss Patent Application CH00610/16, filed on May 10, 2016 and published under the number CH712446, the content of which is incorporated here by reference.

TECHNICAL FIELD

The present invention concerns a watch case with removable and interchangeable horns.

PRIOR ART

Wristwatches generally include a watch case with a middle including horns that are used to attach the wristwatch strap; the usual watch cases include two pairs of horns, each portion of the wristwatch strap being mounted between two horns.

The middles generally consist of a single part manufactured by stamping and incorporating the horns. The manufacture of middles provided with horns with complex shapes is difficult and not well suited to mass production.

There also exist watch case parts in which the middle and the horns are manufactured separately and assembled together afterwards. These cases are easier to manufacture. Moreover, the exterior faces of the middle can be finished by turning, and thus more cleanly and more rapidly than those of a middle manufactured directly with the horns.

The document CH706260, filed by the applicant, describes a watch case part comprising a middle and removable horns interconnected by a connecting part. The middle comprises a hollow location for each horn and a hollow location for each connecting part. The depth of these locations enables positioning of the base of the horns whilst concealing the connecting part. The connecting part is fixed to the middle by two perpendicular screws passing through each horn and engaged in threaded holes within the thickness of the middle. A tool is therefore necessary for demounting the horns. Moreover, the middle must be relatively thick to accommodate therein threaded holes for retaining the horns.

The document EP2431825 describes removable horns, each horn comprising two projecting elements that can be inserted into corresponding openings. The connection between the horn and the middle is effected by exploiting the deformation of the projecting elements during the insertion thereof into the openings. This solution necessitates a thick middle in order to produce the locations adapted to cooperate with the projecting elements. Moreover, there exists a risk of breaking the horns if the force exerted to deform the projecting elements in order to make the connection with the middle is too high.

The document CH701221 describes a middle the exterior lateral surface of which comprises a mortise. The end of a horn comprises a tenon of the same squaring as the mortise. The tenon is arranged to be inserted in the mortise, the two parts then being connected by a pin in a housing formed by holes in the middle and the tenon. The insertion and the withdrawal of the pin necessitate tools. The horns are therefore not easily demountable.

The document EP2188676 describes a watch case with a middle and two pairs of horns. The two horns of each pair are connected by a connecting part having one side held against the middle by means of an elastic member inside the middle. This elastic member is connected to the connecting part through an opening situated on the contour of the middle. This solution therefore necessitates an elastic member inside the middle, mounting of which is complicated. The middle must be thick to accommodate this elastic element. The whole of the middle must be returned to the watch maker for repair in the event of deformation or breakage of the elastic element.

A similar solution is described in EP1902641, which necessitates indexing means in the middle and also in the connecting part, in order to index longitudinally the insertion of a journal of the connecting part in the middle.

The documents CH355094 and CH321188 require a thick middle to be able to produce housings intended to receive a part for connecting the horns.

The document EP0400206 describes a wristwatch middle the wristwatch strap of which is retained on the middle by means of a locking element that can be positioned in a cavity in a part external to the middle and connected to its external surface. This part cooperates with rods enabling fixing of the wristwatch strap.

The document EP0471834 describes a rectangular wristwatch middle comprising a bore in one side of the middle the wall of which has through it an axial slot of width greater than the thickness of the wristwatch strap. A tubular spring and a sleeve one end of which is closed are inserted in this slot. The tubular spring includes a toothed axial slot into which is introduced the free end of a flexible wristwatch strap. The axial introduction of the tubular spring into the sleeve necessitates elastic deformation of the leaf spring leading to immobilization of the free end of the wristwatch strap by pinching the toothed slot. This solution necessitates a middle of great thickness to produce the axial slot receiving the sleeve and the tubular spring. Moreover, this solution is suited only to flexible wristwatch straps.

The document U.S. Pat. No. 5,732,048 describes a watch middle comprising a first hole extending in a first direction (perpendicular to the plane of the movement), adapted to receive a cylinder, and a second hole extending in a second direction perpendicular to the first (and therefore in the plane of the movement), and adapted to receive a screw connected to a connecting part of a wristwatch strap. The cylinder comprises two openings, the first of which is adapted to receive this screw, and the second to receive another screw enabling fixing of the middle to the back (bottom) of the watch case. The middle requires a great thickness to accommodate therein the holes receiving the wristwatch strap connecting screw and the cylinder.

The above watch cases therefore most often include a middle that is difficult to manufacture. The means for fixing the horns to the middle are complex to manufacture and often necessitate a very thick middle. These solutions are therefore not well suited to watch cases of small size or that have to be manufactured at low cost. Moreover, demounting the horns is most often a delicate process, and necessitates watch makers' tools, or even sometimes demounting of the back of the watch, temporarily compromising watertightness.

There therefore exists a requirement for a watch case with the removable horns free of the limitations of the above watch cases or that offers a better compromise between the advantages and the disadvantages of the various solutions.

There also exists a requirement for a simplified method of mounting and demounting the horns.

There also exists a requirement for a simplified method for mounting and demounting the wristwatch strap.

BRIEF SUMMARY OF THE INVENTION

According to the invention, these objects are achieved in particular by means of a watch case including:

a middle;

at least one pair of horns intended to retain a wristwatch strap portion and retained on the middle thanks to a lock that can be switched between a position locking the horns and a position releasing the horns;

the lock including a first member connected to the middle, and a second member complementary to the first member and mounted on the pair of horns;

a manipulation member mounted on the pair of horns and enabling movement of the second member to switch the lock between the position locking and the position releasing the horns.

This solution has the particular advantage of simplifying the manufacture of the middle, which is free of horns and free of a member for manipulating the lock. It can therefore be very thin, and simple to machine.

The complexity is shifted to the pairs of horns, which support the member for manipulating the lock. The horns consist of parts of small size, usually manufactured by milling and are easier to machine in complex shapes.

By transferring the manipulation member to the horns, its manipulation is also facilitated. Moreover, the lower face of the horns does not bear strongly on the wrist, which limits the risk of the manipulation member injuring the skin.

The manipulation member can preferably be manipulated manually, for example with one finger.

The manipulation member can preferably be manipulated without tools.

The manipulation member preferably remains connected to the pair of horns during the release of the pair of horns and during the demounting of the wristwatch strap; all risk of losing screws, pins or other components when demounting the horns or the wristwatch strap is therefore eliminated.

The watch case may include an elastic return element, for example a spring, mounted on the pair of horns in order to push the manipulation member and preferably the second member of the lock back into the locking position.

The manipulation member may be provided on the pair of horns on the back side, that is to say on the side of the horns facing the wrist when the watch is worn. It is therefore concealed when the watch is worn and protected from the risk of unintentional manipulation.

The second member of the lock and the manipulation member may form two parts of the same component.

In one embodiment, the manipulation member may be manipulated between the locking position and the release position by moving it in a vertical direction. The vertical direction is perpendicular to the horizontal plane, itself defined as being the plane of the back of the watch.

In one embodiment, the first member of the lock consists of a bolt connected in fixed manner to the middle. The second member of the lock consists of a keeper movable relative to the pair of horns, between the locking position of the bolt and the release position of the bolt.

In one embodiment, the first member of the lock extends radially on a lateral face of the middle. This member may be anchor-shaped with a central verge that ends in two lateral stocks. The second member of the lock includes a window through which the first member of the lock passes in the locking position. This window, forming a mobile keeper, includes a widened portion enabling insertion and extraction of the first member of the lock, and a narrow portion preventing insertion and extraction of the first member of the lock. The first member of the lock (of anchor shape) passes through the narrow portion of the window when the elastic return element mounted on the pair of horns pushes the second member of the lock back into the locking position, but is prevented from escaping by the stocks of the anchor, which cannot pass through the narrow portion of the window.

The elastic return member may consist of one or more leaf springs bearing on the second member of the lock.

The leaf springs may act in a vertical direction, in order to push the second member of the lock in a vertical direction.

In another embodiment, the direction of movement of the manipulation member between the locking position and the release position is substantially parallel to the horizontal plane. This variant enables reduction of the contact between the manipulation member and the wrist of the user, and therefore limitation of the risk of injuring the user.

In one embodiment, the second member of the lock may be adapted to pivot about an axis perpendicular to the horizontal plane between the locking position and the manipulation position. This axis may be fixed relative to the pair of horns.

In one embodiment, the first member of the lock consists of a groove or other keeper in a lateral face of the middle. The second member of the lock consists of a bolt or other portion engaged in this groove in the locking position, and outside of the groove in the release position.

In one embodiment, the manipulation member may consist of a mobile button that can be actuated by the user and acting on the second member of the lock in the release position in order to unlock it. The manipulation member and the second member of the lock therefore consist of two distinct parts, which if required enables their manufacture in different materials optimized as a function of their own requirements.

In one embodiment, the second member of the lock may be adapted to move radially in translation in the horizontal plane between the locking position and the release position.

The manipulation member may be manipulated horizontally.

The return member may push the manipulation member in a substantially horizontal direction, oriented toward the exterior of the watch.

The pair of horns enables retention of a wristwatch strap portion.

Two pairs of horns may be provided to retain the two portions of the wristwatch strap.

A portion of the wristwatch strap may be sandwiched between the pair of horns and a portion of the middle.

The arrangement may include a vertical stack including, from bottom to top: a portion of the pair of horns; the end of the wristwatch strap, inserted in this portion and between the two horns; a portion of the middle.

Demounting or replacing the wristwatch strap may necessitate demounting the horns.

The retention of the wristwatch strap is therefore facilitated. The wristwatch strap is therefore simpler and more economical to produce. The complexity of the removable connection is transferred to the pairs of horns, which are long-lasting parts.

A spring ball may be provided in the wristwatch strap in order to position the wristwatch strap relative to the pair of horns.

The application also has for subject matter a method of assembling a wristwatch strap to a watch case including the following steps:

insertion of the wristwatch strap in a pair of horns;

insertion of the assembly formed of the wristwatch strap and of the pair of horns on an exterior face of the watch case;

locking of the assembly by manipulating a manipulation member mounted on the pair of horns.

BRIEF DESCRIPTION OF THE FIGURES

Embodiments of the invention are indicated in the description illustrated by the appended figures in which.

EMBODIMENT(S) OF THE INVENTION

A first embodiment of the invention is illustrated in FIGS. 1 to 9.

Figure 1:
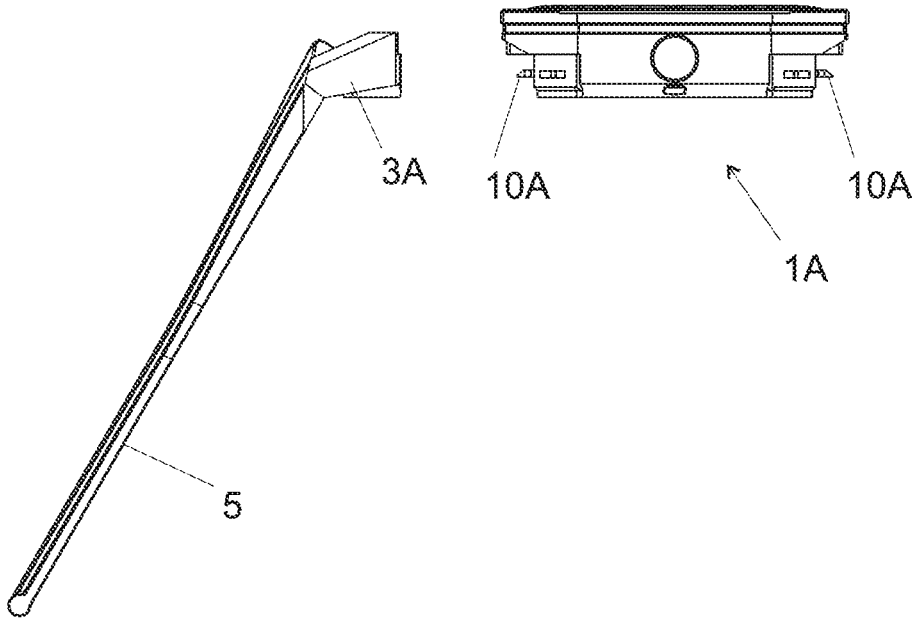
FIG. 1 illustrates a side view of a watch case and of a pair of horns with a wristwatch strap section, before assembly, according to a first embodiment.
Figure 2:
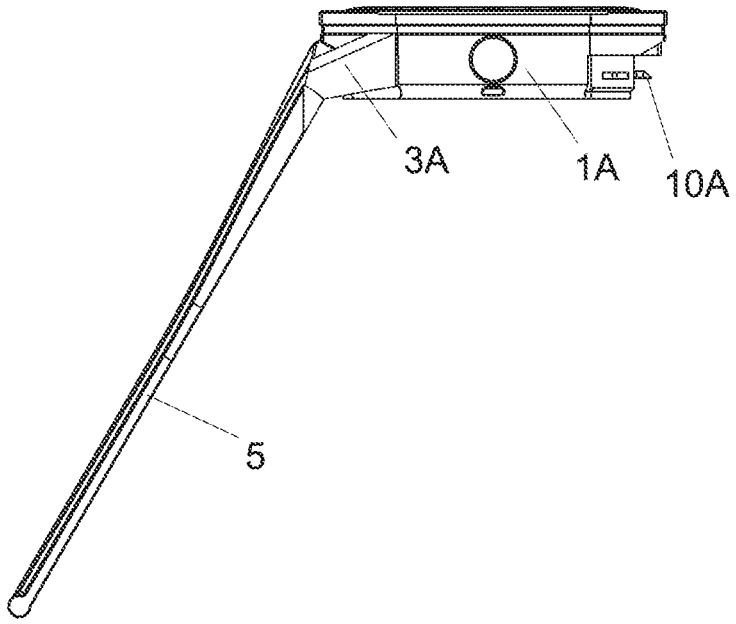
FIG. 2 illustrates a side view of a watch case and of a pair of horns with a wristwatch strap section, after assembly, according to a first embodiment.
Figure 3:
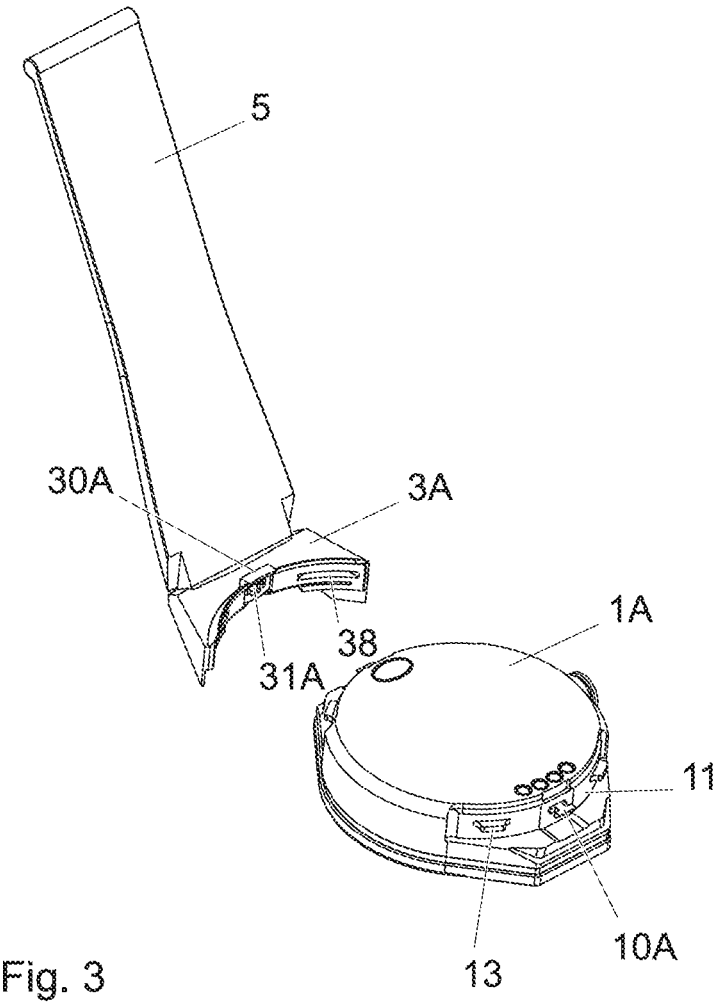
FIG. 3 illustrates a back view of a watch case and of a pair of horns with a wristwatch strap section, before assembly, according to a first embodiment.

FIG. 1 illustrates a watch case including a middle 1A and a removable pair of horns 3A, on which is mounted a wristwatch strap portion 5. Another removable pair of horns and another wristwatch strap portion not shown can be mounted on the opposite side of the middle. FIG. 3 is a back view of these elements.

The wristwatch strap portion 5 is inserted temporarily in the pair of horns 3 (here 3A) by moving it vertically (that is to say in a direction substantially perpendicular to the plane of the back of the watch). The assembly formed of the horns and of the wristwatch strap is then assembled to the middle 1 (here 1A-FIG. 2). This assembly of the pair of horns 3 on the middle 1 also enables retention of the wristwatch strap portion by preventing axial extraction thereof as in the other embodiments.

A lock including a fixed first member 10A connected to the watch case and a second member 31A (FIG. 4) enables locking of the assembly between the pair of horns 3A and the middle 1A. The pair of horns 3A, and therefore the wristwatch strap portion 5, can be released from the middle only by manipulating the second member of the lock to move it from the locking position to a release position, as described hereinafter.

Figure 6:
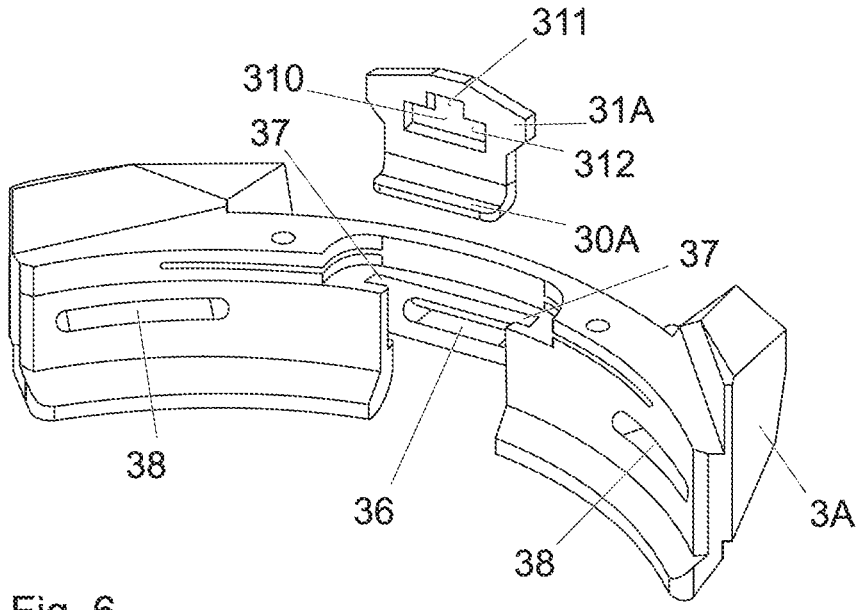
FIG. 6 illustrates a perspective view of a pair of horns and of a second member of the lock, according to a first embodiment.
Figure 7:
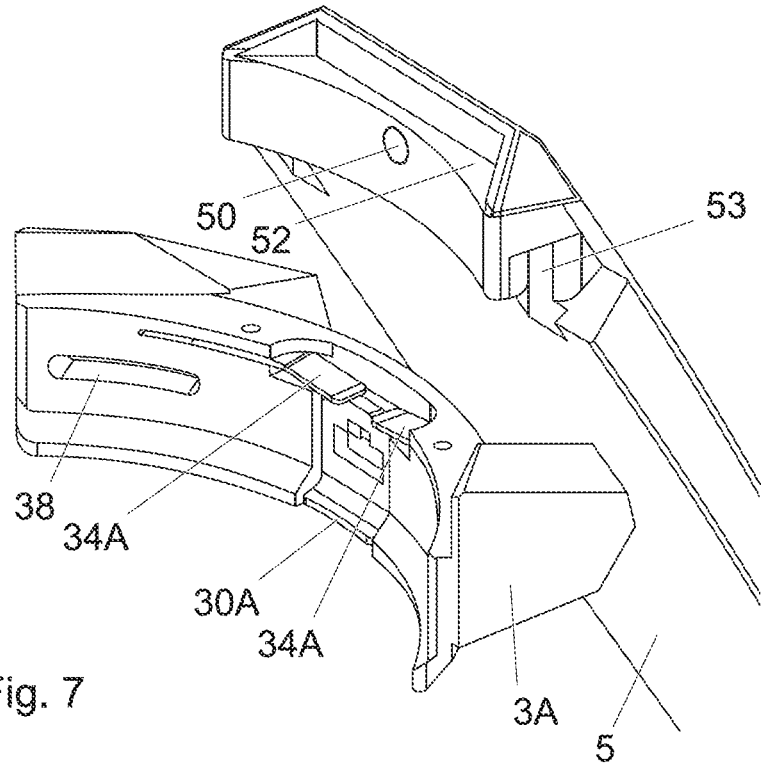
FIG. 7 illustrates a perspective view of a pair of horns and a wristwatch strap section before assembly, according to a first embodiment.

FIG. 6 illustrates one of the two pairs of horns 3A and the second locking member 31A. This member 31A can slide vertically in two slots 37 formed in the pair of horns 3A. An elastic return element, formed here of two leaf springs 34A (FIG. 7), exerts a return force on the second member of the lock in order to push it back into the locking position, that is to say toward the bottom of the figure.

The second locking member 31A constitutes one part of a component that also includes a manipulation member 30A. The manipulation member can be seen under the internal face of the pair of horns, as seen for example in FIG. 3. The user can manipulate it, without any tools, in order to push the second locking member toward the top of the figure, that is to say into the release position of the lock.

The second locking member 31A includes a window 310 constituting a keeper in which the first member 10A can be inserted. In this embodiment, the locking of the pair of horns 3A to the middle 1A is therefore effected with a lock mechanism with a fixed bolt connected to the middle and a sliding keeper connected to the pair of horns. The first member 10A of the lock has the shape of an anchor with a verge and two stocks extending one from each side at the end of the verge. The window 310 has an inverted T shape with a widened portion 312 enabling the insertion or the extraction of the first member 10A, and a narrower portion 311 preventing the passage of this first member 10A.

The wristwatch strap is temporarily inserted between the two horns of the pair 3A, before the mounting of this pair on the middle 1A. Complementary shapes 53 at the end of the wristwatch strap and in the between horns space enable nesting. The end of the wristwatch strap 5 is moreover retained in position by means of a ball 50 on a spring 51 that are positioned in a housing 35 (FIG. 8) formed between the two horns of the pair 3A.

In the same manner, the pair of horns 3A is positioned on the external face of the middle 1A thanks to the nesting of the complementary shapes 38 on the pair of horns 3A and 13 on the lateral faces of the middle 1A.

Figure 8:
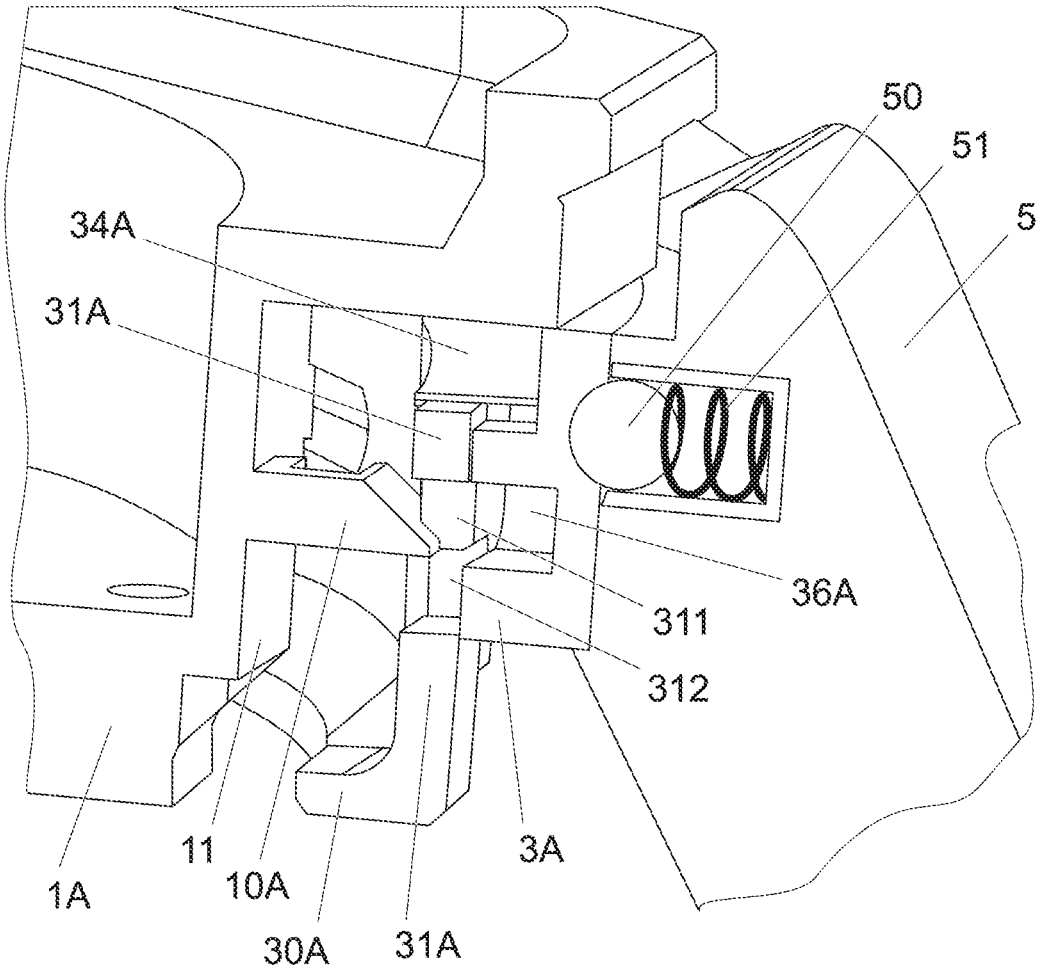
FIG. 8 illustrates a view in radial section of a watch case portion and of a pair of horns with a wristwatch strap section, during assembly of and before locking of the pair of horns according to a first embodiment.
Figure 9:
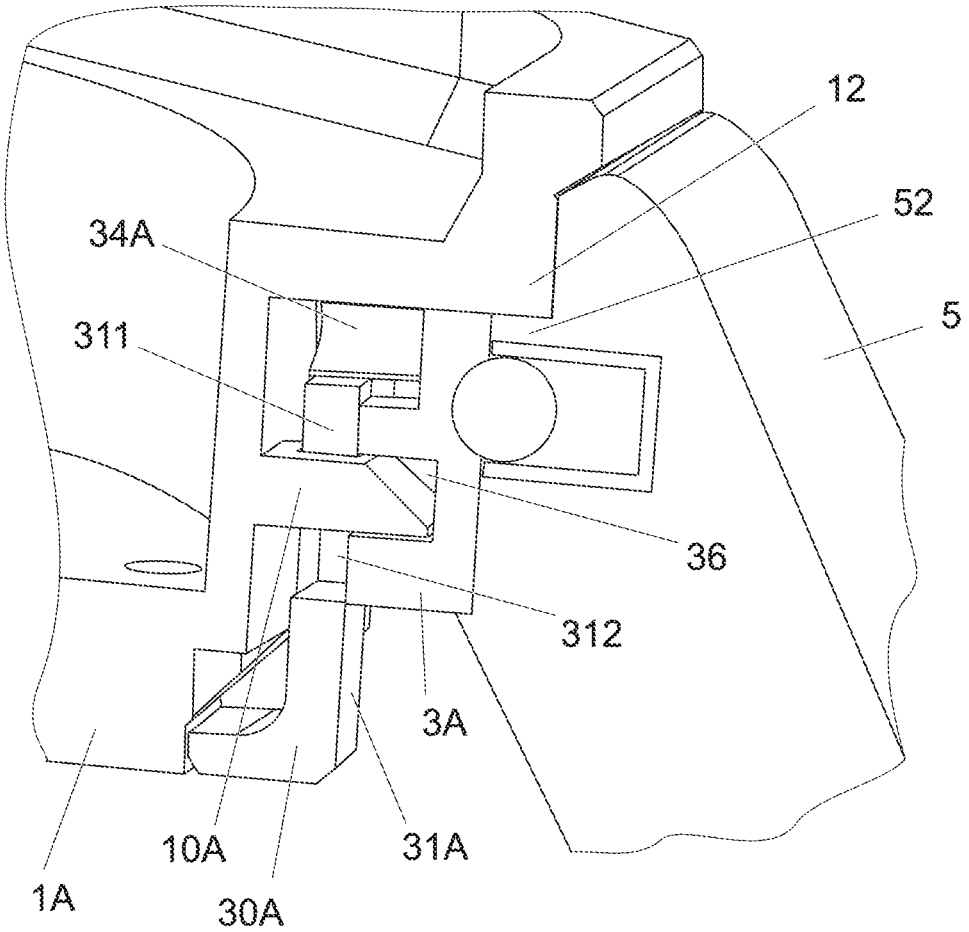
FIG. 9 illustrates a view in radial section of a watch case portion and a pair of horns with a wristwatch strap section, during assembly of and after locking of the pair of horns according to a first embodiment.
Figure 10:
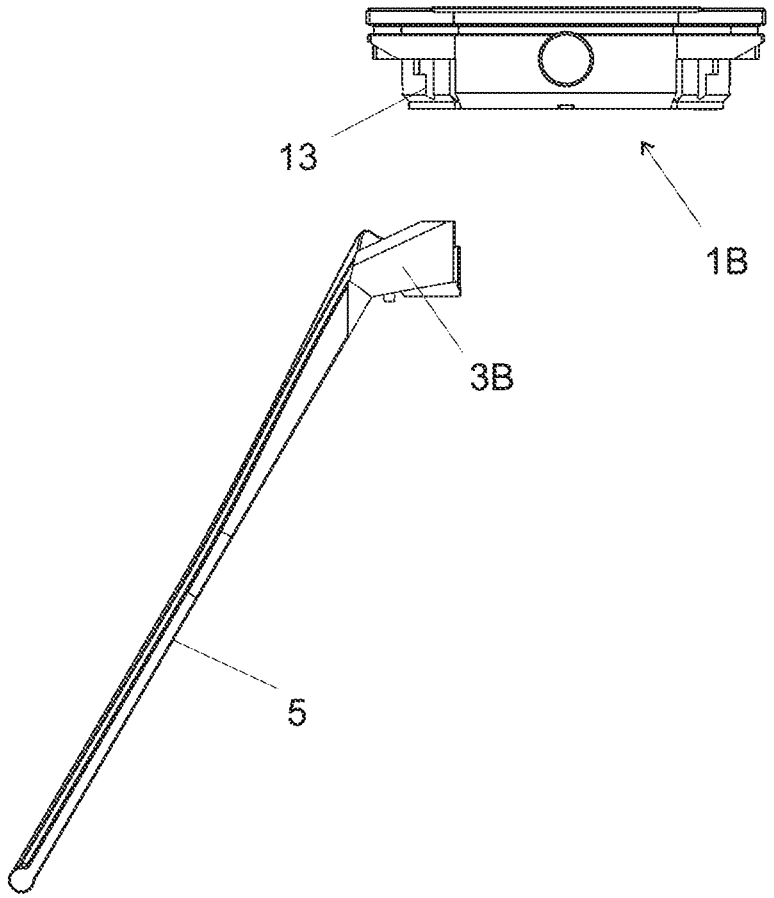
FIG. 10 illustrates a side view of a watch case and a pair of horns with a wristwatch strap portion, before assembly, according to a second embodiment.
Figure 11:
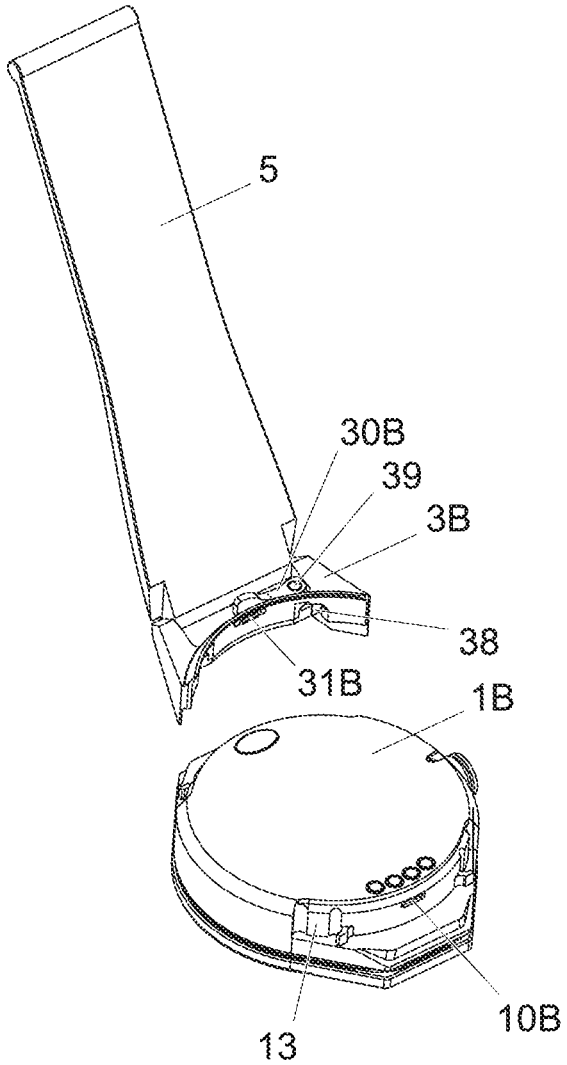
FIG. 11 illustrates a back view of a watch case and of a pair of horns with a wristwatch strap portion, before assembly, according to a second embodiment.
Figure 12:
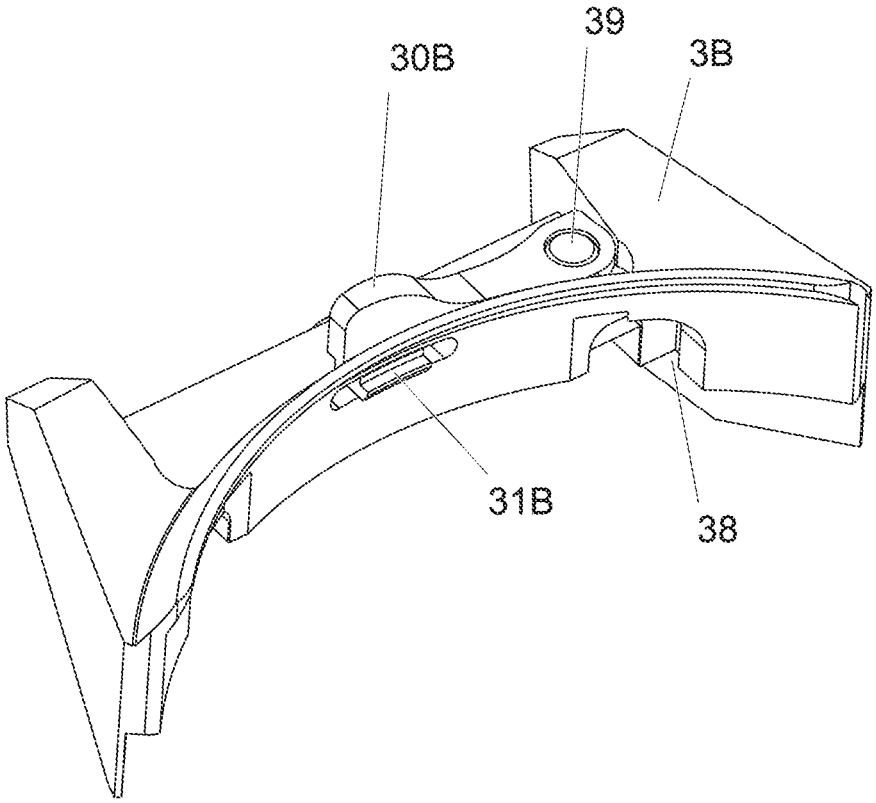
FIG. 12 illustrates a perspective view of a pair of horns and of a second member of the lock, according to a second embodiment.
Figure 13:
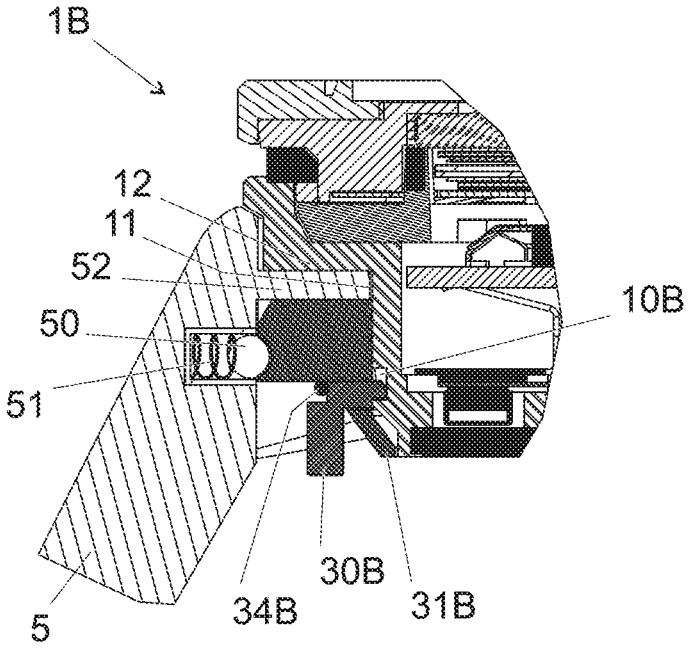
FIG. 13 illustrates a view in radial section of a watch case portion and of a pair of horns with a wristwatch strap portion, during assembly of and after locking of the pair of horns according to a second embodiment.
Figure 14:
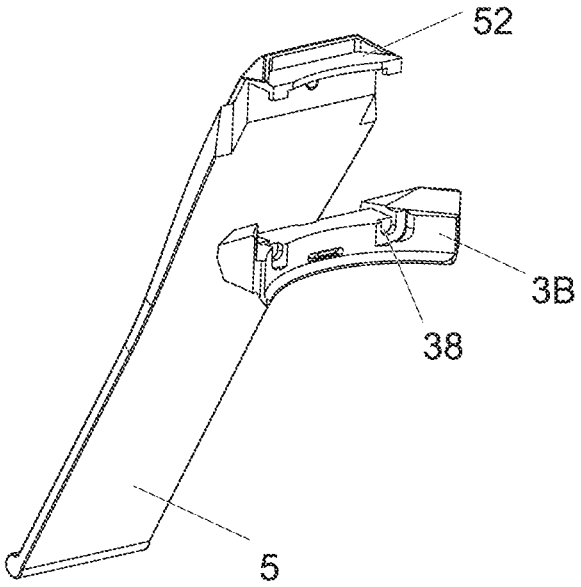
FIG. 14 illustrates a wristwatch strap portion and a pair of horns, before assembly thereof.
Figure 15:
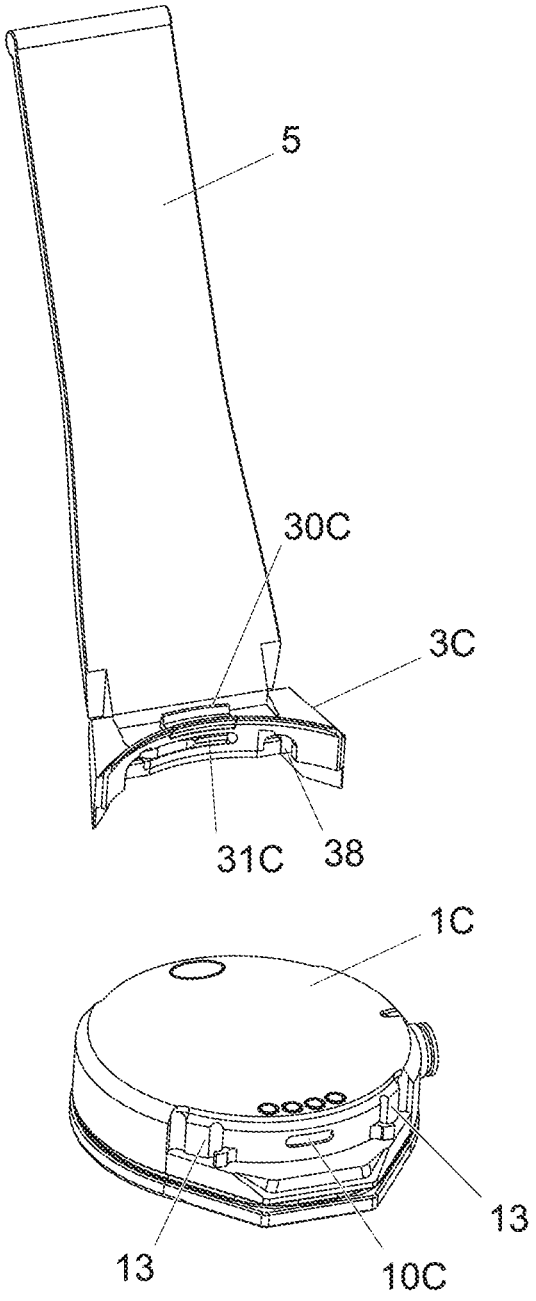
FIG. 15 illustrates a back view of a watch case and of a pair of horns with a wristwatch strap portion, before assembly, according to a third embodiment.
Figure 16:
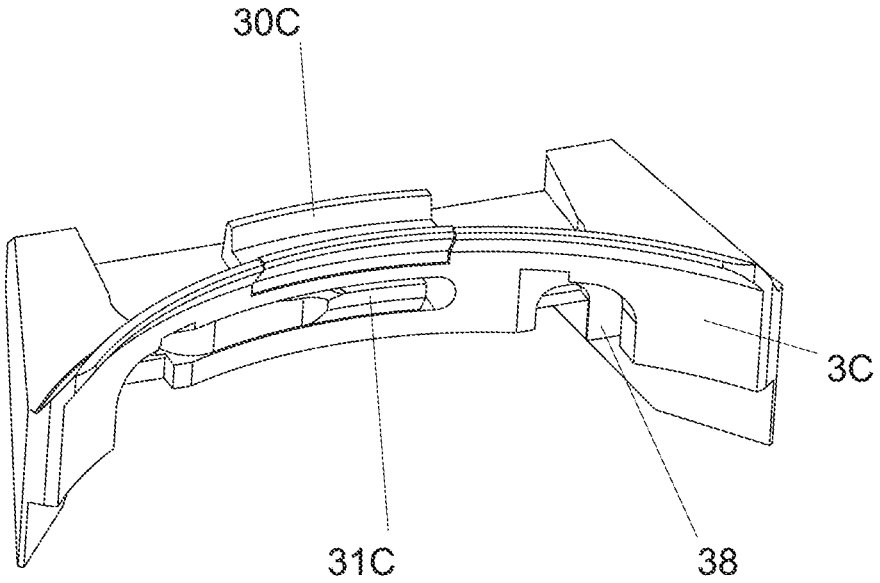
FIG. 16 illustrates a perspective view of a pair of horns and of a second member of the lock, according to a third embodiment, the manipulation member being in a locking position.
Figure 17:
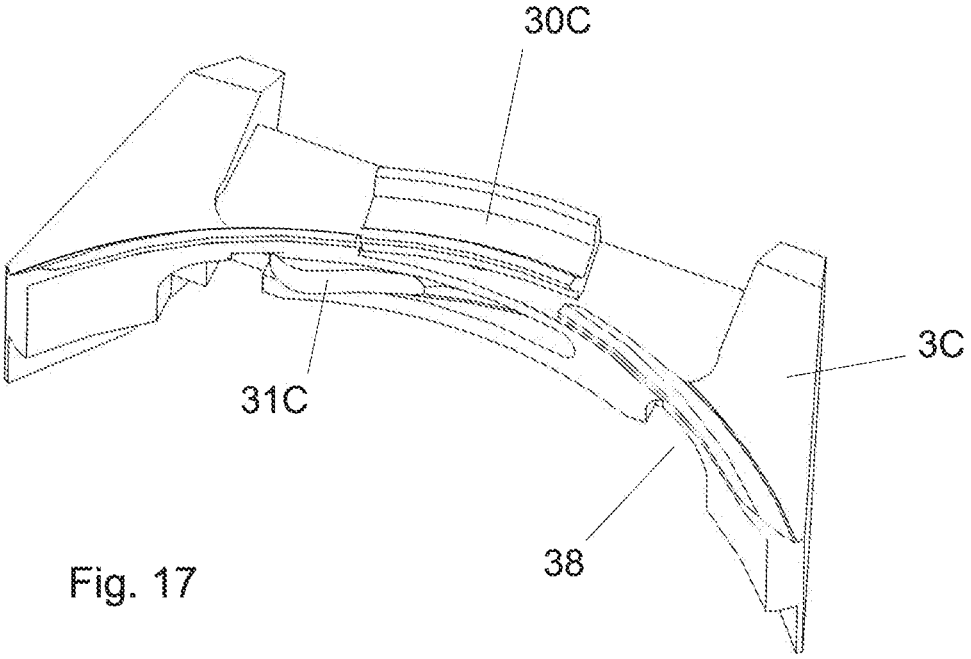
FIG. 17 illustrates a perspective view of a pair of horns and of a second member of the lock, according to a third embodiment, the manipulation member being in a release position.
Figure 18:
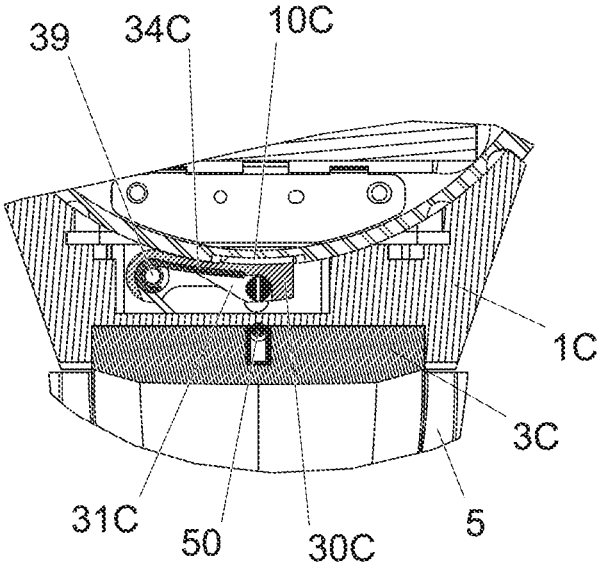
FIG. 18 illustrates a view in horizontal section of a watch case portion and of a pair of horns with a wristwatch strap portion, after assembly, according to a third embodiment.
Figure 19:
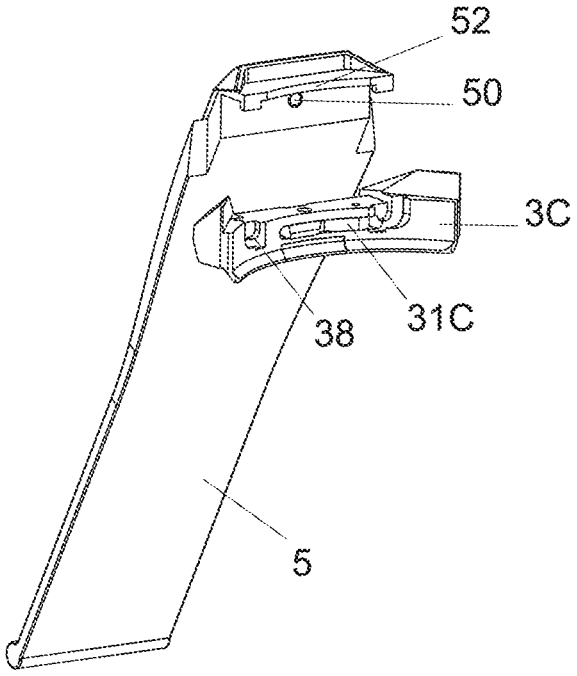
FIG. 19 illustrates a wristwatch strap portion and a pair of horns according to the third embodiment before assembly thereof.

FIGS. 4, 5 and 8, 9 illustrate different views in section of the pair of horns 3A assembled to the middle 1A. FIG. 8 illustrates the position of the various elements before locking. In this figure, the second member 31A is pushed downward, in the locking position, by the return spring 34A.

By pushing the pair of horns 3A and the wristwatch strap portion 5 radially against the middle 1A, the pressure of an inclined portion at the end of the first member 10A against the second member 31A causes the latter to rise into the release position, which enables the first member 10A to pass through the window 310. The second member 31A is then moved downward again by the action of the return spring 34A, which has the effect of locking the first member 10A and therefore of retaining the assembly comprising the middle and the pair of horns in the position illustrated in FIGS. 4, 5 and 9.

The pair of horns 3A can be released only by manipulating the manipulation member 30A to move the window 310 downward again into the release position, enabling extraction of the first member 10A.

Figure 4:
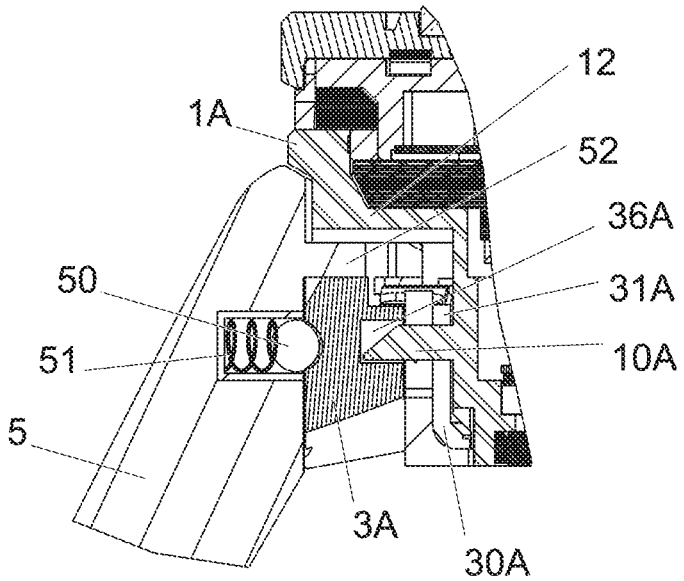
FIG. 4 illustrates a view in radial section of a watch case portion and a pair of horns with a wristwatch strip section, after assembly, according to a first embodiment.
Figure 5:
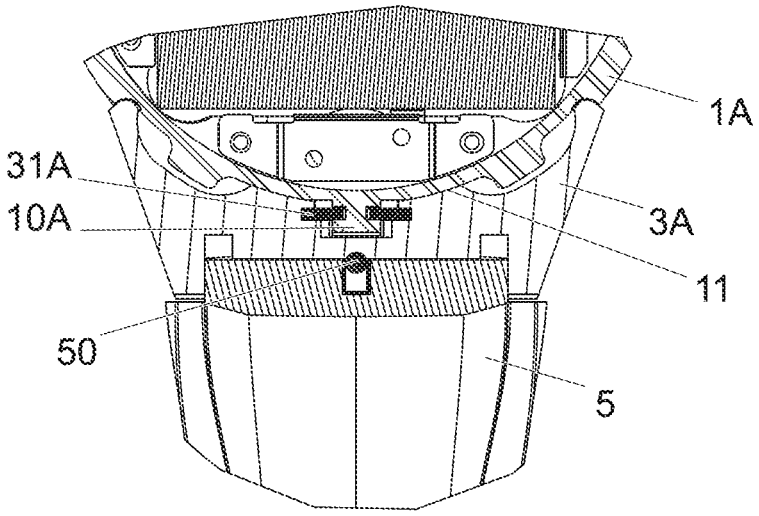
FIG. 5 illustrates a view in horizontal section of a watch case portion and a pair of horns with a wristwatch strap section, after assembly, according to a first embodiment.

The wristwatch strap portion 5 is retained between the pair of horns 3 (here 3A) and the middle 1 (here 1A), and therefore cannot be removed without unlocking and then removing the pair of horns 3. To be more precise, as seen in FIG. 4 in particular, a portion 52 at the longitudinal end of the wristwatch strap portion 5 is sandwiched between a portion 12 of the middle 1A and the pair of horns 3A. In the horizontal plane, the movement of the wristwatch strap portion 5 is limited by the two horns of the pair 3A.

A second embodiment of the invention is illustrated in FIGS. 10 to 14. As seen in FIGS. 10 and 11, it again includes a watch case with a middle 1B, removable pairs of horns 3B, and a wristwatch strap 5 retained between these horns 3B and the middle 1B. Complementary shapes 13 on the middle and 38 on the pair of horns can be nested to assemble these elements before locking thereof. As in the other embodiments, complementary shapes also enable nesting of the end of the wristwatch strap portion 5 against the external face of the pair of horns 3B, before the retention thereof by assembling the pair of horns to the middle 1B.

In this embodiment, as in the embodiments 3, 4 and 5 described hereinafter, the pairs of horns 3B are mounted on the middle 1B by an axial, that is to say vertical, movement. The complementary shapes 13 on the middle 1B constitute slideways and enable axial guidance of this relative movement of the pairs of horns 3B relative to the middle 1B.

The lock enabling locking of this assembly once the horns are in position consists in this embodiment of a groove 10B on the lateral face of the middle 1B (first member), and a second member 31B that is mobile in rotation and mounted on the pair of horns 3B, in order to prevent axial movement thereof. The second member 31B can pivot about a vertical axis 39 under the lower face of the pair of horns, between a locking position engaged in the groove 10B (FIG. 13), and a release position enabling mounting or demounting of the pair of horns 3B. To this end, the second member 31B is connected to a manipulation member 30B which enables the extraction thereof in the release position, by causing it to pivot about the axis 39. A return spring 34B, for example a wire spring, exerts a bearing pressure of the second member 31B at the bottom of the groove 10B. The other aspects of this second embodiment may be identical or equivalent to those of the first embodiment.

A third embodiment is illustrated in FIGS. 15 to 19. As in the second embodiment, the pair of horns 3 is unlocked on the middle 1C by moving a second member 31C of the lock with a movement of rotation about an axis 39 connected to the pair of horns 3C, in such a manner as to disengage it from the first member 10C consisting of a groove on the periphery of the middle 1C. A return spring 34*c* pushes this second member to the bottom of the groove in the locking position, in such a manner as to prevent axial movement of the pair of horns 3C relative to the middle. The lock therefore prevents the separation of the pair of horns 3C relative to the middle 1C.

However, in this embodiment, the manipulation member 30C consists of a component separate from the second member 31C of the lock. In this example, the manipulation member consists of a button sliding in a horizontal plane between the locking and release positions. The manipulation member 30C and the second member 31B are connected to one another by a pin passing through an oblong opening under the lower face of the pair of horns.

Figure 20:
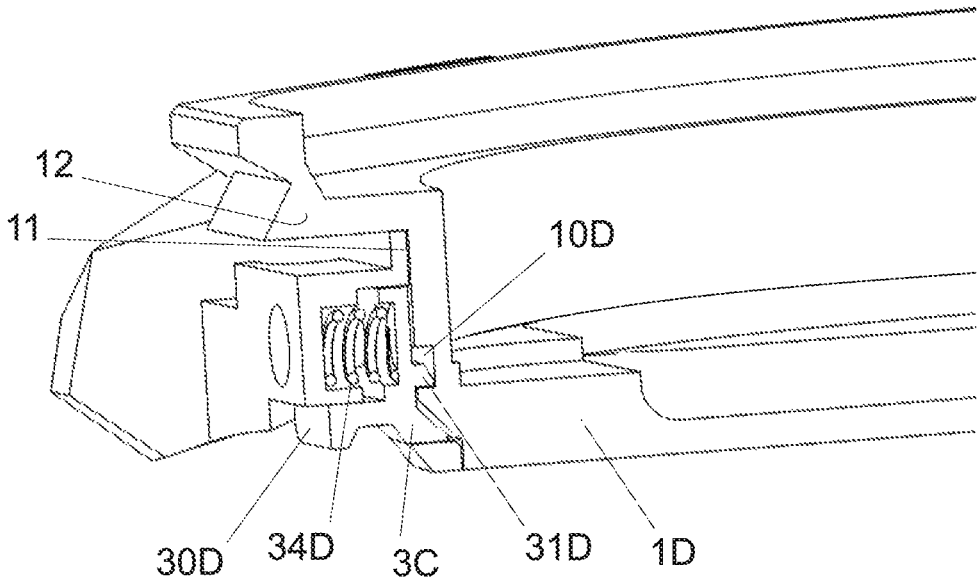
FIG. 20 illustrates a view in radial section of a watch case portion and of a pair of horns (without the wristwatch strap) according to a fourth embodiment after locking thereof.
Figure 21:
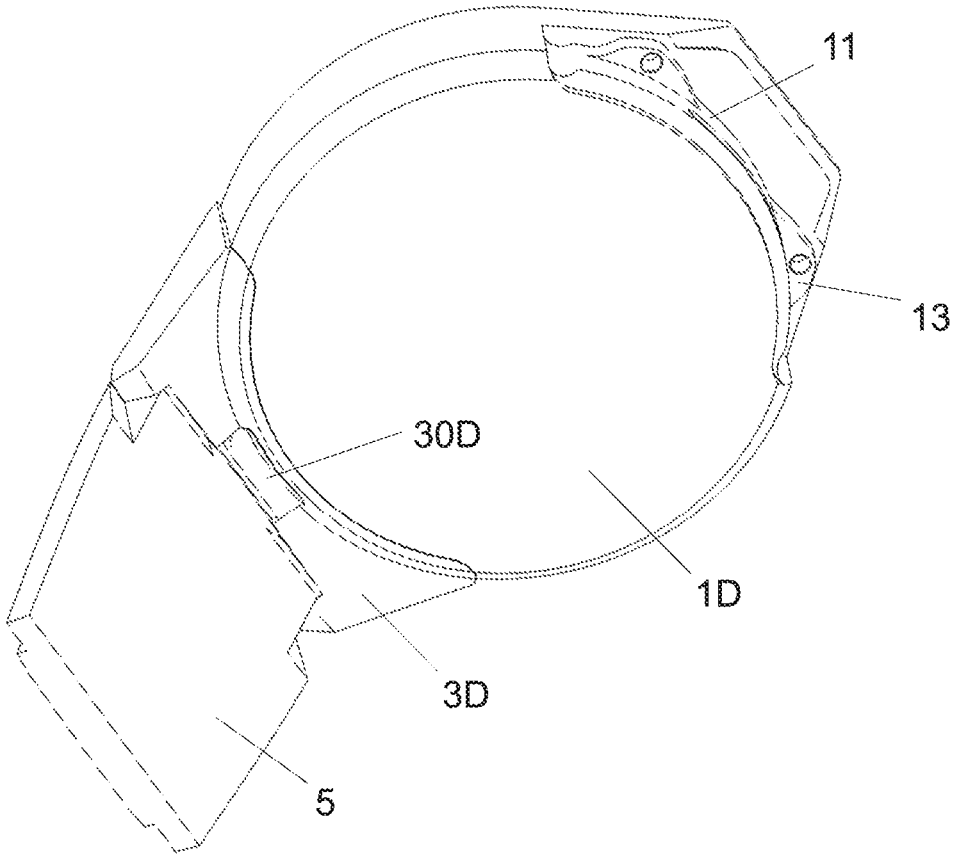
FIG. 21 illustrates a back view of a watch case and of a pair of horns with a wristwatch strap portion, before assembly, according to a fourth embodiment.
Figure 22:
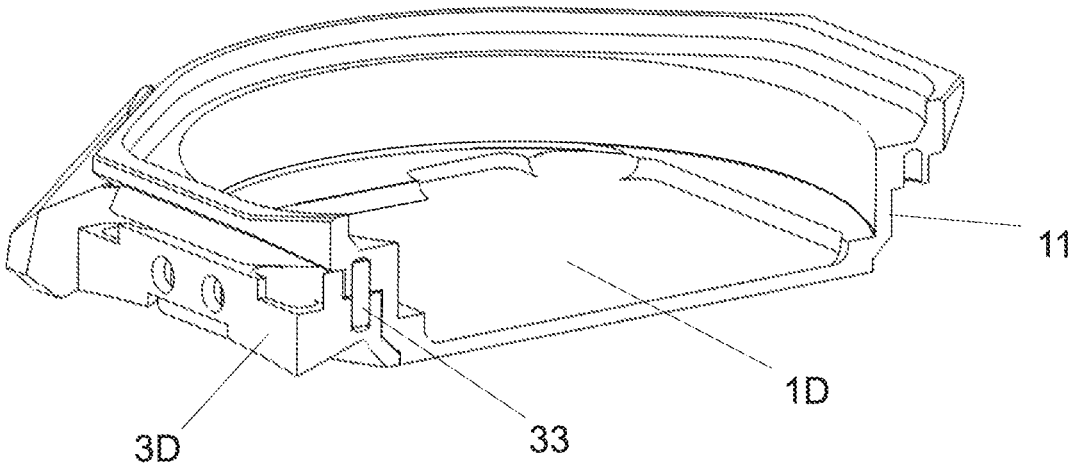
FIG. 22 illustrates a view in vertical section of a watch case portion and of a pair of horns (without the wristwatch strap), showing the complementary shapes used for the assembly thereof.
Figure 23:
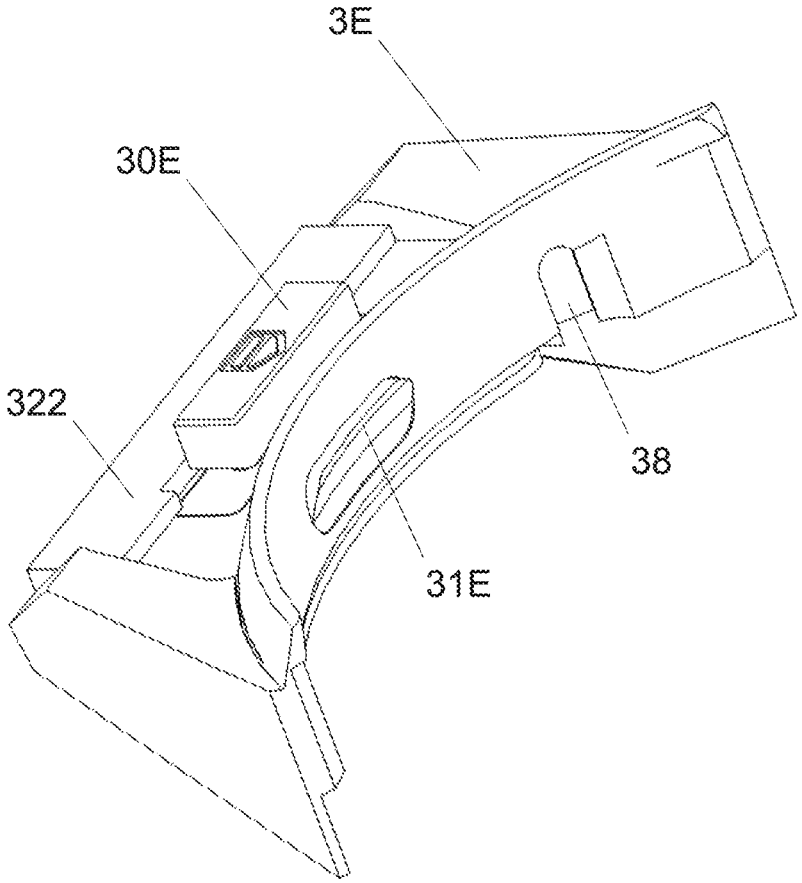
FIG. 23 illustrates a view in perspective and from below of a pair of horns without the wristwatch strap, according to a fifth embodiment of the invention.
Figure 24:
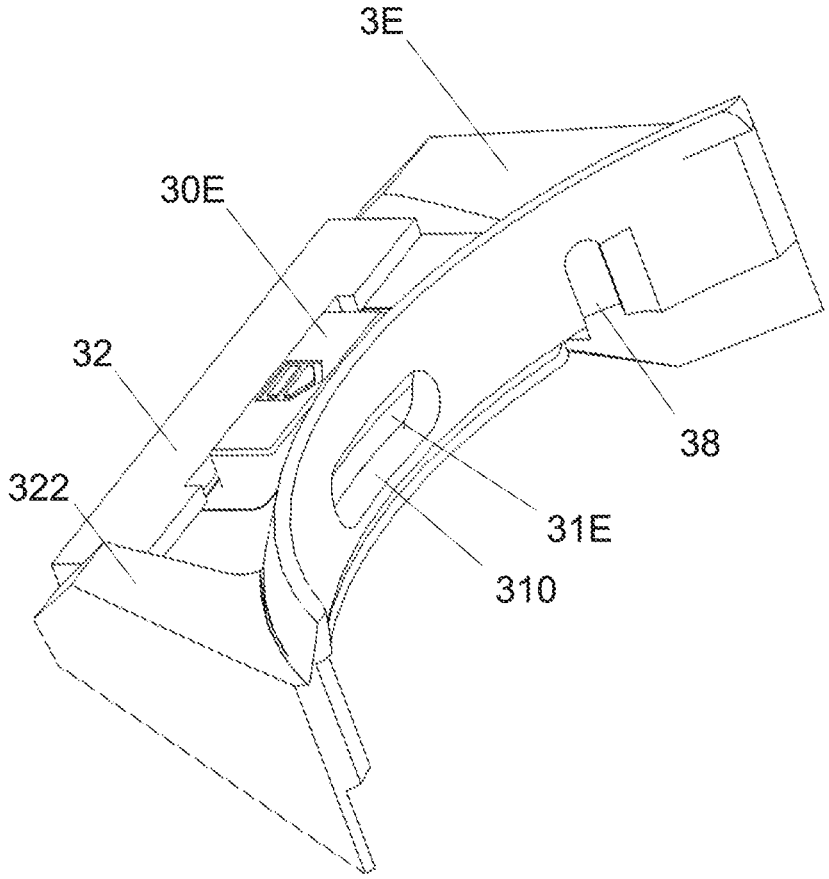
FIG. 24 illustrates a perspective view of the pair of horns from FIG. 23, the manipulation member being depressed in the release position.

FIGS. 20 to 22 illustrate a fourth embodiment of the invention. In this example, the first member of the lock consists of a groove 10D forming a keeper at the periphery of the middle 1D. The second member of the lock consists of a bolt 31D at the end of a sliding bolt including a manipulation member 30D under the lower face of the pair of horns 3D. A return spring 34D housed in a blind hole 32 on the face of the pair of horns 3D pushes back the sliding bolt in such a manner as to engage the second member 31D (bolt) in the groove 10D (keeper). In this locked position, the lock prevents axial movement of the pair of horns relative to the middle 1D. The manipulation member 30D can be pulled outward in order to disengage the two members of the lock and to insert or to extract the pair of horns by moving it axially relative to the middle 1D.

FIGS. 23 to 28 illustrate a fifth embodiment of the invention. In this example, the first member of the lock again consists of a groove 10E (FIG. 27) forming a keeper at the periphery of the middle 1E and preventing the extraction of the pair of horns 3E by a vertical (axial) movement. The second member of the lock consists of a bolt 31E that moves radially in this groove, being guided in this movement by an opening 310 on the internal face of the pair of horns 3E.

Figure 25:
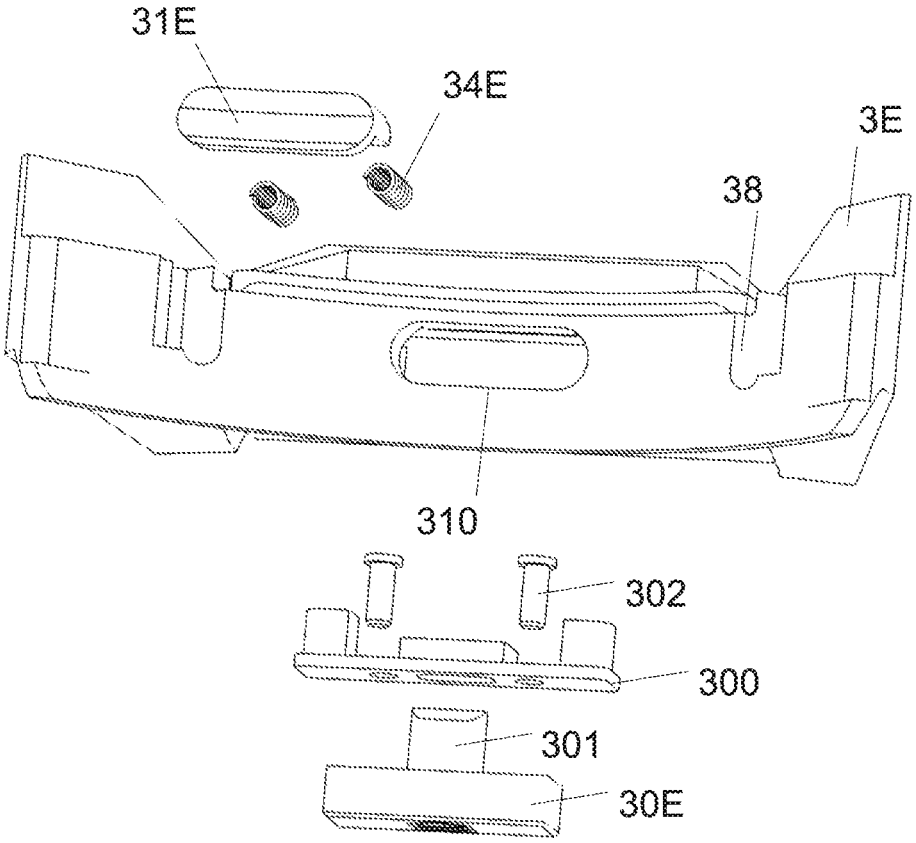
FIG. 25 illustrates an exploded view of a pair of horns without the wristwatch strap, according to the fifth embodiment of the invention.
Figure 26:
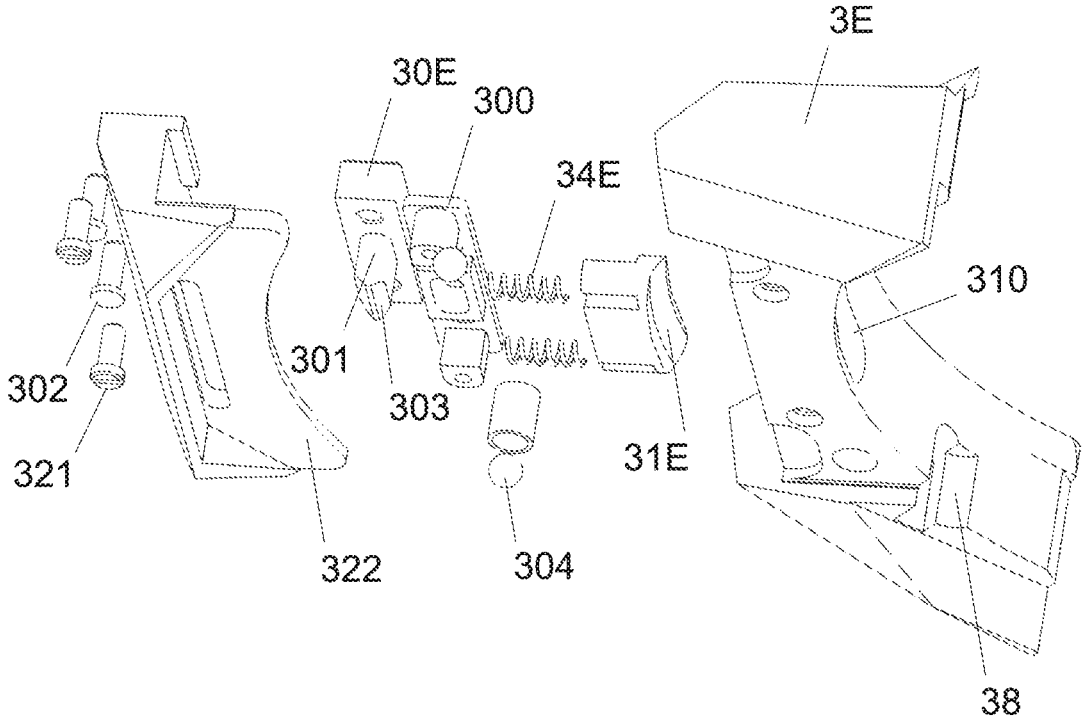
FIG. 26 illustrates another exploded view of a pair of horns without the wristwatch strap, according to the fifth embodiment of the invention.
Figure 27:
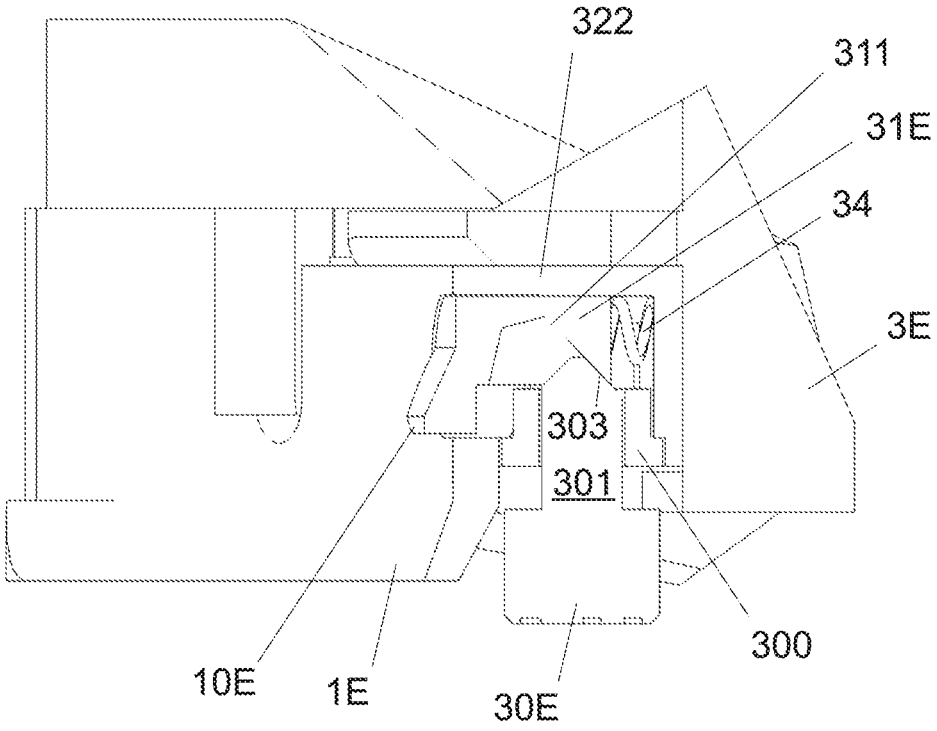
FIG. 27 illustrates a view in radial section of a pair of horns without the wristwatch strap, according to the fifth embodiment of the invention, the manipulation member being in the locking position.
Figure 28:
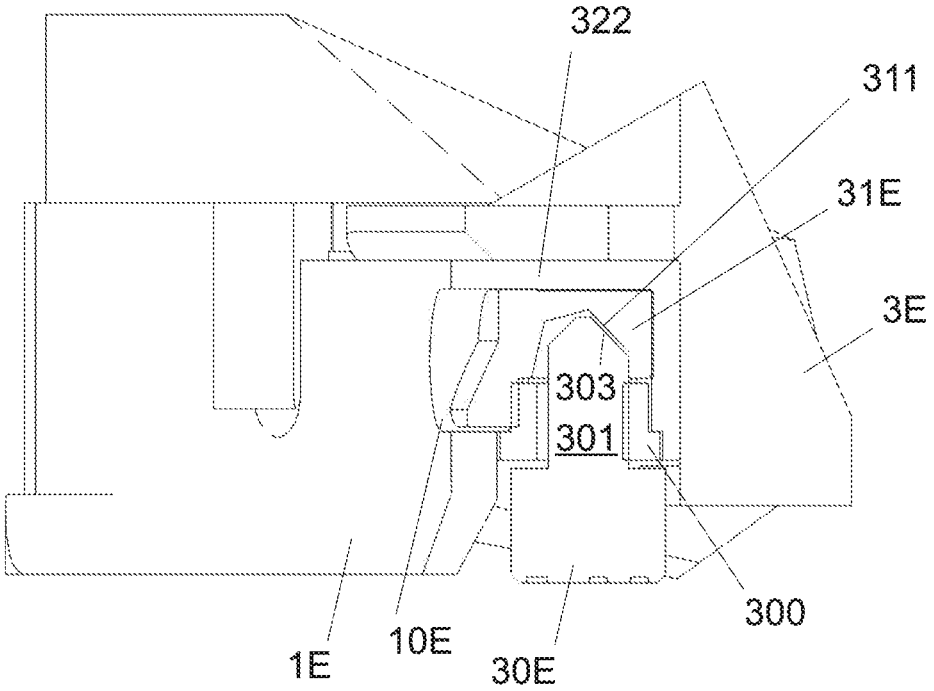
FIG. 28 illustrates a view in radial section of a pair of horns without the wristwatch strap, according to the fifth embodiment of the invention, the manipulation member being in the release position.
Figure 29:
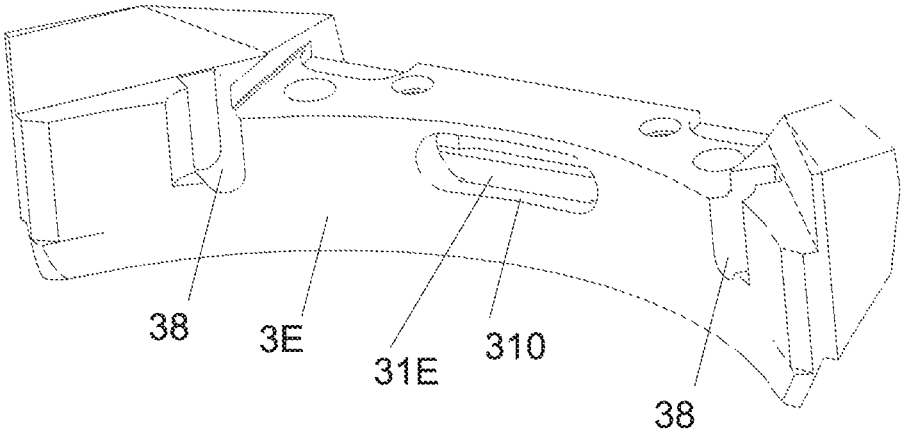
FIG. 29 illustrates a view in radial perspective of a pair of horns according to the fifth embodiment of the invention, illustrating in particular the complementary shapes for guidance on the middle.

In the locking position, the second member 31E is pushed to the bottom of the groove 10E by two return springs 34E connected to the pair of horns 3E, here coil springs visible in particular in FIGS. 25 and 26.

In the release position, the second member 31E is moved radially in the direction of the exterior of the watch, against the action of the return springs 34E. This movement is produced by the manipulation member 30E consisting of a pushbutton under the internal face of the pair of horns. The button 30E includes a rod 301 the end of which forms a bevel 303. This bevel 303 is pressed against a complementary bevel 311 under the second member 31E, in such a manner as to move this second member 31E between the locking position illustrated in FIG. 28 and the release position illustrated in FIG. 28. In this release position, the end of the second member 31E has entered completely inside the horns and no longer projects beyond the window 310.

The manipulation member 30E is guided in its vertical movement by a cover 300 through which the rod 301 passes. Spring balls 304 exert a force to push this member back when it is not depressed. Pins 302 on either side of the rod 301 moreover enable vertical movement of the manipulation member 30E.

The whole of the device is hidden by a cap 322 screwed to the between-horns space by means of screws 320.

The end of the second member 31E is provided with a beveled slant to enable withdrawal thereof on insertion of the pair of horns onto the middle 1E.

As already mentioned, each pair of horns is nested on the middle 1 of the embodiments 2 to 5 by an axial relative movement, along the vertical axis; the lock enables the nested position to be maintained.

This vertical movement is guided thanks to the fitting together of complementary shapes 38 on the pair of horns 3 and 13 on the middle 1. In the embodiment from FIG. 22, these complementary shapes include pins 33 engaged in blind holes in the middle and in the pair of horns 3. In the embodiment of FIGS. 23 to 29, the complementary shapes 38 on the pair of horns 3E include two end mills (blind grooves). This guide element 38 necessitates only a shallow depth and is entirely concealed when the pair of horns is mounted.

REFERENCE NUMBERS EMPLOYED IN THE FIGURES

1 Middle
3 Pair of horns
5 Wristwatch strap portion
10 First member of the lock, connected to the middle
11 Lateral face of the middle
12 Portion of the middle sandwiching the wristwatch strap
13 Complementary shape
30 Manipulation member
300 Guide cover of the manipulation member 30
301 Rod of the manipulation element 30
302 Guide pins of the manipulation element 30
303 Beveled end of the rod 302
304 Spring ball
31 Second member of the lock
310 Window for passage of the second lock
32 Blind hole housing the return spring
322 Cap
33 Pins for positioning the horns on the middle
34 Elastic return element
35 Housing in the pair of horns for the ball 50
36 Housing in the pair of horns for the end of the first member
37 Vertical slots
38 Complementary shape
39 Axis of the first member
50 Spring ball
51 Spring
52 Portion of the wristwatch strap sandwiched between the pair of horns and a portion of the middle
53 Complementary shape

What is claimed is:

1. A watch case including:

a middle; and at least one pair of horns intended to retain a wristwatch strap portion and retained on the middle thanks to a lock that can be switched between a position locking the horns and a position releasing the horns; the lock including a first member connected to the middle, and a second member complementary to the first member and mounted on the pair of horns;

wherein a manipulation member is mounted on the pair of horns and enables movement of the second member to switch the lock between the position locking the horns and the position releasing the horns, and wherein a portion of the wristwatch strap portion is sandwiched between the pair of horns and part of the middle in a vertical direction, said vertical direction being perpendicular to a horizontal plane, said horizontal plane being the plane of the watch case facing a wrist of a user when the watch case is worn by the user.

2. The watch case as claimed in claim 1, including an elastic return element mounted on the pair of horns in order to push the manipulation member back into the locking position.

3. The watch case as claimed in claim 1, the manipulation member being provided on a back side of the pair of horns.

4. The watch case as claimed in claim 1, in which the second member of the lock and the manipulation member form two parts of a same piece.

5. The watch case as claimed in claim 1, the watch case including a bottom defining said horizontal plane, the direction of movement of the manipulation member between the locking position and the release position being substantially perpendicular to the horizontal plane.

6. The watch case as claimed in claim 5, the first member of the lock consisting of a bolt fixedly connected to the middle, the second member of the lock consisting of a keeper movable relative to the pair of horns.

7. The watch case as claimed in claim 5, the first member of the lock extending radially on a lateral face of the middle, the second member of the lock including a window through which the first member of the lock passes in the locking position, the window including a widened portion enabling the insertion and the extraction of the first member of the lock, and a narrow portion preventing the insertion and the extraction of the first member of the lock, the first member of the lock passing through the narrow portion of the window when the elastic return member mounted on the pair of horns pushes the second member of the lock back into the locking position.

8. The watch case as claimed in claim 5, the elastic return member consisting of two leaf springs bearing on the second member of the lock.

9. The watch case as claimed in claim 1, the watch case including a back defining said horizontal plane, the direction of movement of the manipulation member between the locking position and the release position being substantially parallel to the horizontal plane.

10. The watch case as claimed in claim 9, the second member of the lock being adapted to pivot about said vertical direction perpendicular to the horizontal plane between the locking position and the manipulation position.

11. The watch case as claimed in claim 10, the first member of the lock consisting of a groove in a lateral face of the middle, the second member of the lock being engaged in said groove in the locking position, and outside of said groove in the release position.

12. The watch case as claimed in claim 9, the manipulation member consisting of a mobile button that can be actuated by the user and acting on the second member of the lock in the release position in order to unlock it.

13. The watch case as claimed in claim 9, the second member of the lock being adapted to move radially in translation in the horizontal plane between the locking position and the release position.

14. The watch case as claimed in claim 13, the first member of the lock consisting of a groove in a lateral face of the middle, the second member of the lock being engaged in said groove in the locking position, and outside of said groove in the release position.

15. The watch case as claimed in claim 1, the pair of horns and the middle having complementary shapes to guide the pair of horns during its insertion in said vertical direction on the middle, the lock acting radially to prevent this vertical movement in the locking position.

16. The watch case as claimed in claim 1, including a spring ball for positioning the wristwatch strap portion relative to the pair of horns.

17. A method of assembling the wristwatch strap portion to the watch case as claimed in claim 1, including the following steps:

insertion of the wristwatch strap portion in the pair of horns;

insertion of the assembly formed of the wristwatch strap and of the pair of horns on an exterior face of the watch case, so that the portion of the wristwatch strap portion is sandwiched between the pair of horns and part of the middle in the vertical direction;

locking of the assembly by manipulating a manipulation member mounted on the pair of horns.

18. A watch case including:

a middle:

at least one pair of horns configured to retain a wristwatch strap portion and retained on the middle; and a lock that can be switched between a position locking the horns to the middle and a position releasing the horns from the middle, the lock including a first member connected to the middle, and a second member complementary to the first member and mounted on the pair of horns;

wherein a manipulation member is mounted on the pair of horns and enables movement of the second member to switch the lock between the position locking the horns and the position releasing the horns, the first member of the lock comprises a groove at the periphery of the middle preventing the extraction of the pair of horns by an axial movement, the second member of the lock comprises a bolt that is moved radially in this groove, being guided in this movement by an opening on the internal face of the pair of horns, the second member is pushed back to the bottom of the groove by two return springs connected to the pair of horns, and the manipulation member comprises a pushbutton under the internal face of the pair of horns cooperating with the second member to move it radially in the direction of the exterior of the watch, against the action of the return springs, when said pushbutton is actuated.

* * * * *